United States Patent [19]

Arai et al.

[11] Patent Number: 4,899,028

[45] Date of Patent: Feb. 6, 1990

[54] SUCTION AND EXHAUST SYSTEM OF A HEAT COOKING APPARATUS

[75] Inventors: Akihiko Arai; Kazuichi Okada, both of Hirakata; Tetsuo Kamo, Yawata; Eiji Shiota, Hirakata, all of Japan

[73] Assignee: Matsushita Electric Industrial Co., Ltd., Osaka, Japan

[21] Appl. No.: 315,220

[22] Filed: Feb. 24, 1989

Related U.S. Application Data

[63] Continuation of Ser. No. 129,739, Dec. 7, 1987, abandoned.

[30] Foreign Application Priority Data

Dec. 11, 1986 [JP] Japan ..... 61-295254

[51] Int. Cl.[4] ..... H05B 6/12; E24C 15/10

[52] U.S. Cl. ..... 219/10.493; 219/10.67; 219/460; 126/21 A; 126/299 D

[58] Field of Search ..... 219/10.493, 10.67, 460, 219/462; 126/21 A, 21 R, 37 A, 39 H, 299 D

[56] References Cited

U.S. PATENT DOCUMENTS 3,587,555 6/1971 Cerola ..... 219/460 X
4,431,892 2/1984 White ..... 219/10.493
4,468,548 8/1984 Yamaki ..... 219/10.67 X
4,490,596 12/1984 Hirai et al. ..... 219/10.49 R
4,549,052 10/1985 Simon ..... 219/10.49 R
4,551,600 11/1985 Miyagawa et al. ..... 219/10.49 R
4,665,893 5/1987 Miyagawa et al. ..... 219/10.67 X

FOREIGN PATENT DOCUMENTS 58-104430 6/1983 Japan ..... 126/299 D

*Primary Examiner*—Philip H. Leung
*Attorney, Agent, or Firm*—Wenderoth, Lind & Ponack

[57] ABSTRACT

According to the electromagnetic cooking apparatus of the present invention, a ventilation hole, through which air after cooling an interior compartment of the main casing of the cooking apparatus is exhausted, communicates with the exhaust passage of the exhaust device so that the suction force of a fan member of the exhaust device is also utilized for exhausting the cooling air, thereby contributing to an improvement in the exhausting efficiency of the cooking apparatus, and the fact that a relatively small fan motor for the cooling device can be used. Consequently the cooling device can be small, which in turn enables the size of the electromagnetic cooking apparatus itself to be relatively small.

2 Claims, 4 Drawing Sheets

SUCTION AND EXHAUST SYSTEM OF A HEAT COOKING APPARATUS

This application is a continuation, of now abandoned application Ser. No. 129,739, filed Dec. 7, 1987.

BACKGROUND OF THE INVENTION

1. Field of the Invention

The present invention relates to a heat cooking apparatus which is provided with an exhaust device.

2. Description of the Prior Art

A conventional built-in type electromagnetic induction heat cooking apparatus of the type referred to above, which will be referred to hereinbelow as an electromagnetic cooking apparatus, has been constructed in the manner shown in FIGS. 6–8.

More specifically, in a casing 1 of the prior art electromagnetic cooking apparatus, a main body 6 includes a heating coil 2, a frequency modulating device 3, a cooling unit 4, and a top plate 5. A down draft exhaust device 9 which absorbs grease laden smoke 8 or the like generated from within a pan 7 during cooking is, together with the main body 6 of the cooking apparatus, installed in a cabinet 10. The down draft exhaust device 9 has a fan 11 provided therewithin, and an exhaust passage terminating at an exhaust intake 12 formed in a top plate 10'. A discharge port 14 of the down draft exhaust device 9 extends through a wall face 13.

As shown in FIG. 7, the suction air enters the main body 6 enters a suction passage from a suction port **15*a* of a grill 15 provided above the main body 6 being drawn into the cabinet 10 so as to flow over the casing 1 by a fan 4' of the cooling unit 4. Then, as shown in FIG. 8, the suction air is exhausted upwards through a suction passage and out of an exhaust port 15*b* of the grill 15**.

In the conventional electromagnetic cooking apparatus having the above-described construction, however, since the suction and exhaust passages in the main body are defined separately from an exhaust passage of the down exhaust device, it is disadvantageous in that only the cooling unit 4 can be used for cooling the main body 6, thus requires a large motor for the cooling unit 4. As a result, a thin and compact main body 6 can not be employed in the conventional cooking apparatus.

SUMMARY OF THE INVENTION

An essential object of the present invention is to provide an improved electromagnetic cooking apparatus in which a ventilation hole of a main body of the apparatus is open to an air passage of an exhaust device, so that a cooling unit in the main body of the apparatus can be compact, thereby contributing to a thin and compact structure of the electromagnetic cooking apparatus itself.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
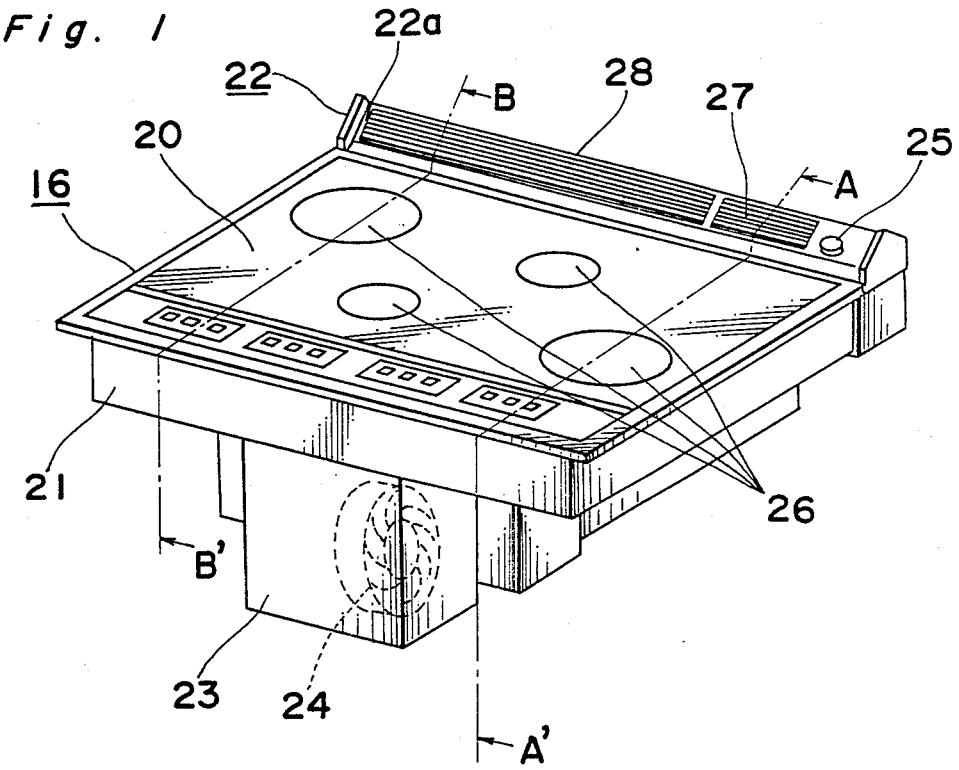
FIG. 1 is a perspective view of an electromagnetic cooking apparatus according to a first embodiment of the present invention.
Figure 2:
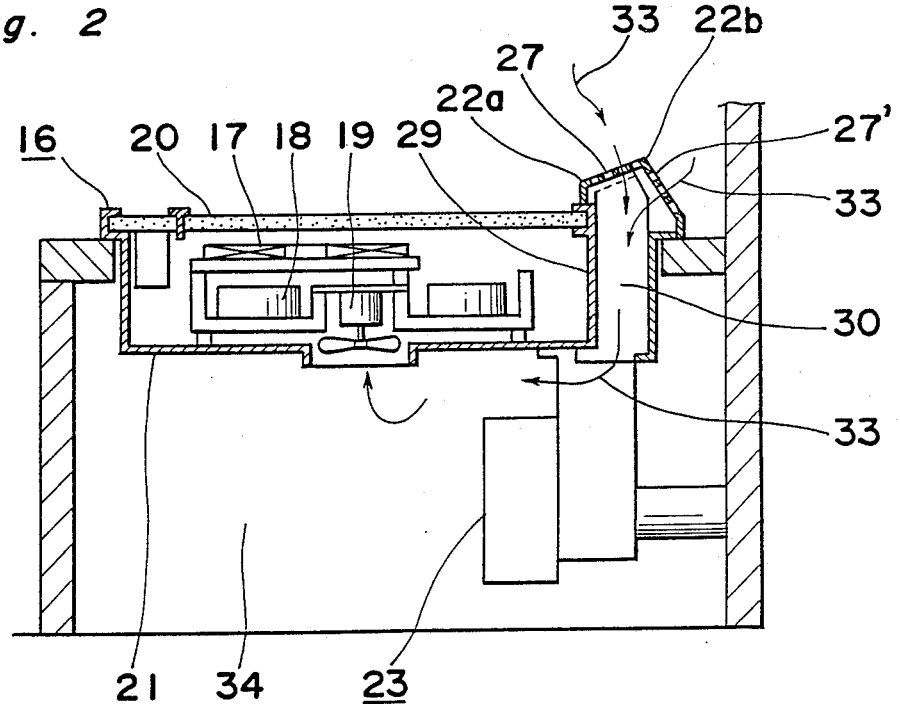
FIG. 2 is a cross-sectional view taken along the line A—A' of FIG. 1.
Figure 3:
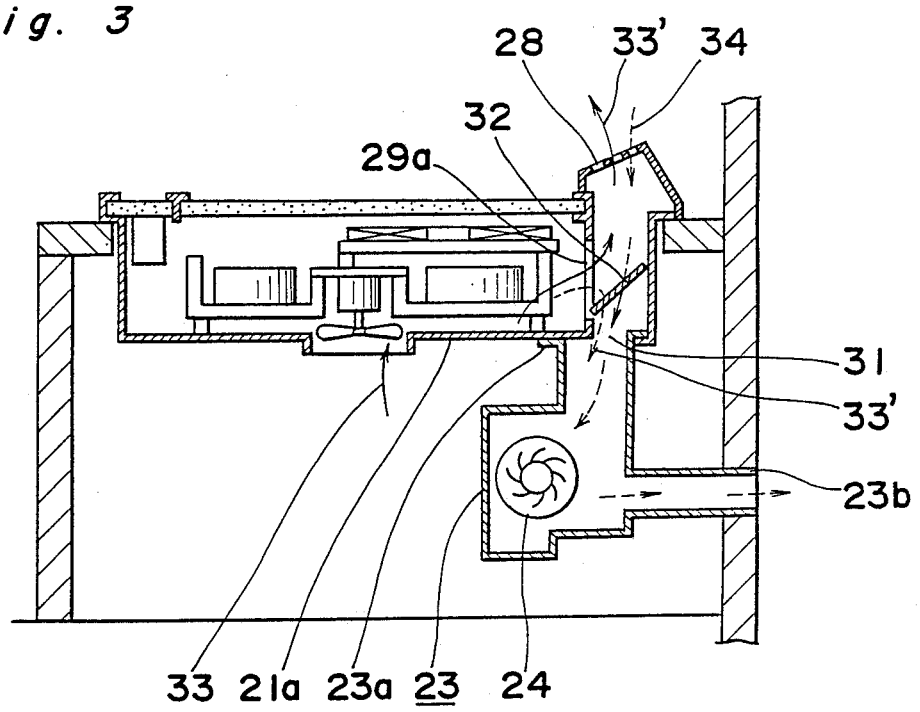
FIG. 3 is a cross-sectional view taken along the line B—B' of FIG. 1.

Before the description of the present invention proceeds, it is to be noted that like parts are designated by like reference numerals throughout the accompanying drawings. Referring to FIGS. 1–3, a main casing 16 of the electromagnetic induction heat cooking apparatus (hereinafter referred to as an electromagnetic cooking apparatus) comprises a heating coil 17, a frequency conversion device 18 and a cooling unit 19, a compartment 21 having a top plate 20 provided thereabove, and a grill 22. A down exhaust device 23, which is formed by, for example, a conduit having a fan 24 provided therewithin is connected at its upper connection port **23*a* to a bottom portion 21*a* of the compartment 21. An exhaust opening 23*b* of the down exhaust device 23** is open to the outside of the apparatus through the wall surface.

A switch 25 for driving a fan 24 of the down exhaust device 23 is disposed at the right end on a front surface **22*a* of the grill 22 so as not to be easily effected by a heating burner 26. A suction port 27 is formed at the front surface 22*a*, while a rear suction port 27' is formed at a rear surface 22*b* confronting the front surface 22*a*. Moreover, an exhaust intake 28 is formed at the front surface 22*a*. The exhaust passage communicating with the exhaust intake 28 and the suction passage communicating with the suction port 27 are defined by a partition plate 29 and a partition plate 30, respectively, within the compartment 21. The partition plate 29 has ventilation holes 29*a* which communicate with the exhaust passage. On the other hand, the bottom portion 21*a* of the compartment 21 has ventilation openings 31. A filter 32 is placed in the exhaust passage extending within the compartment 21 in an inclined position as seen in FIG. 3**.

The operation of the electromagnetic cooking apparatus according to the first embodiment will be described hereinbelow.

The description will first be directed to the suction and exhaust system of the air in the electromagnetic cooking apparatus. The air 33 for cooling the apparatus entering the apparatus from the suction port 27 at the front surface **22*a* of the grill 22 and the rear suction port 27' at the rear surface 22*b* of the grill 22 is guided along the suction passage of the compartment 21 into the cabinet 34. The cooling air 33 is sucked by the cooling unit 19 through the ventilation openings 31 to cool components inside the compartment 21. Thereafter, the cooling air 33 is exhausted through the ventilation holes 29*a* formed in the exhaust side of the partition plate 29 so as to flow toward the exhaust passage extending inside the compartment 21**. At this time, the cooling air 33 is guided upwards by the filter 32 placed in the exhaust passage extending within the casing 21. The foregoing description refers to a mode in which the down exhaust device 23 is not operating. On the contrary, when the down exhaust device 23 is operating, since the exhaust passage extending within the compartment 21 is part of the down exhaust device 23 coupled at the bottom portion 21*a*, most of the exhausted air 33' from the main casing is sucked into the fan unit 24, due to the strong suction force of the fan 24. Only a small part of the exhausted air 33' is occasionally discharged upwards through the exhaust intake 28. Moreover, the down exhaust device 23 itself need not be greatly effected to suck grease laden smoke or the like produced during cooking, and therefore, the grease laden smoke 34 or the like is sucked in to the exhaust device from the exhaust intake 28 of the grill 22 so as to pass through the filter 32 to remove the grease therefrom.

Thus, according to the present invention, both the cooling unit 19 and the fan 24 of the down exhaust device 23 can be used for cooling the main body of the apparatus, so that the efficiency of the cooking apparatus is remarkably improved.

A suction and exhaust system of an electromagnetic cooking apparatus according to second and third embodiments of the present invention will be respectively described hereinbelow with reference to FIGS. 4 and 5.

Figure 4:
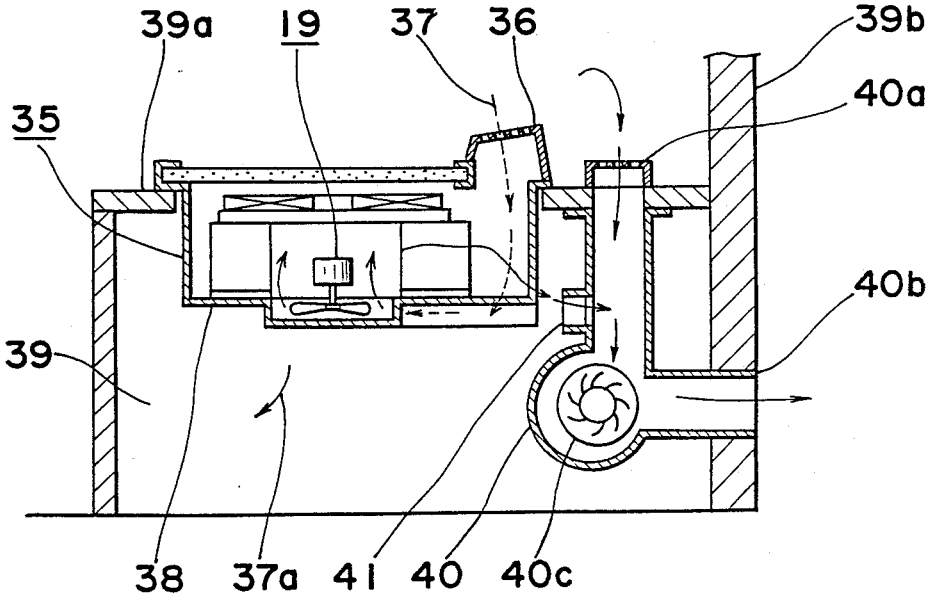
FIG. 4 is a longitudinal cross-sectional view of an electromagnetic cooking apparatus according to a second embodiment of the present invention.

Referring to FIG. 4, the cooling air 37 is sucked into the apparatus from a grill 36 above a main casing 35 of the cooking apparatus to cool inner components in a compartment 38 and then is exhausted into a cabinet 39. A down exhaust device 40 has an upper exhaust intake 40*a* formed on a top plate 38*a* and an exhaust opening 40*b* defined in a wall surface 39*b*. A fan member 40*c* is installed in the interior of the exhaust device 40. The exhaust device 40 is also provided with an inlet 41 open to the cabinet 39. In the second embodiment, exhausted air 37*a* exhausted from the main casing 35 into the cabinet 39 is sucked through the inlet 41, and accordingly, it is unnecessary to install a partition wall or the like in the casing of the main casing 35 so as to separate the suction side from the exhaust side.

Figure 5:
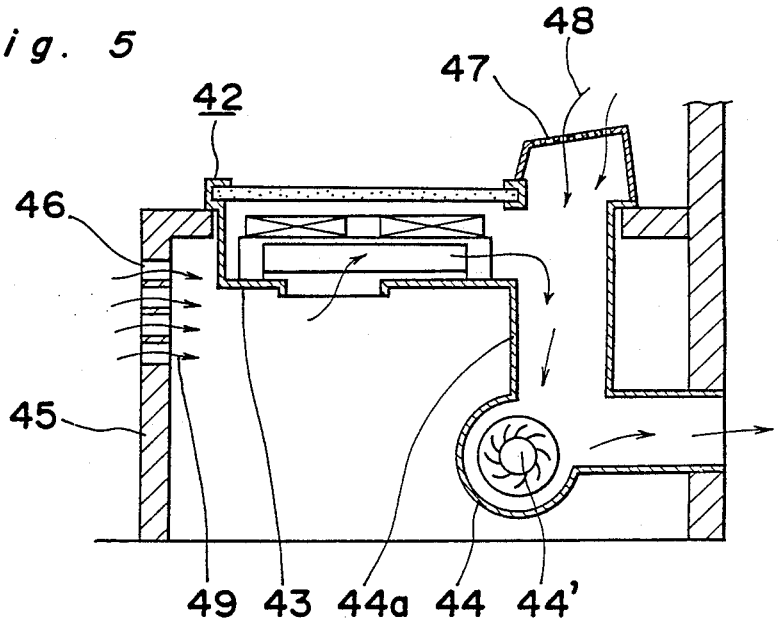
FIG. 5 is a longitudinal cross-sectional view of an electromagnetic cooking apparatus according to a third embodiment of the present invention.
Figure 6:
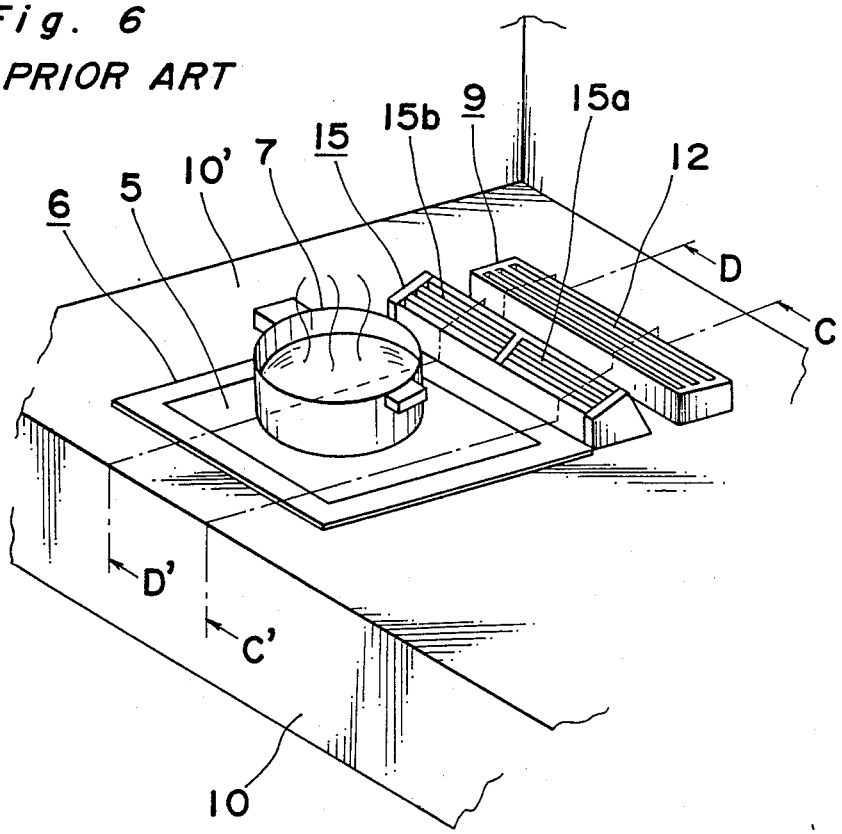
Fig. 6 PRIOR ART
FIG. 6 is a perspective view of a conventional electromagnetic cooking apparatus provided with a down draft exhaust device installed in a top plate.
Figure 7:
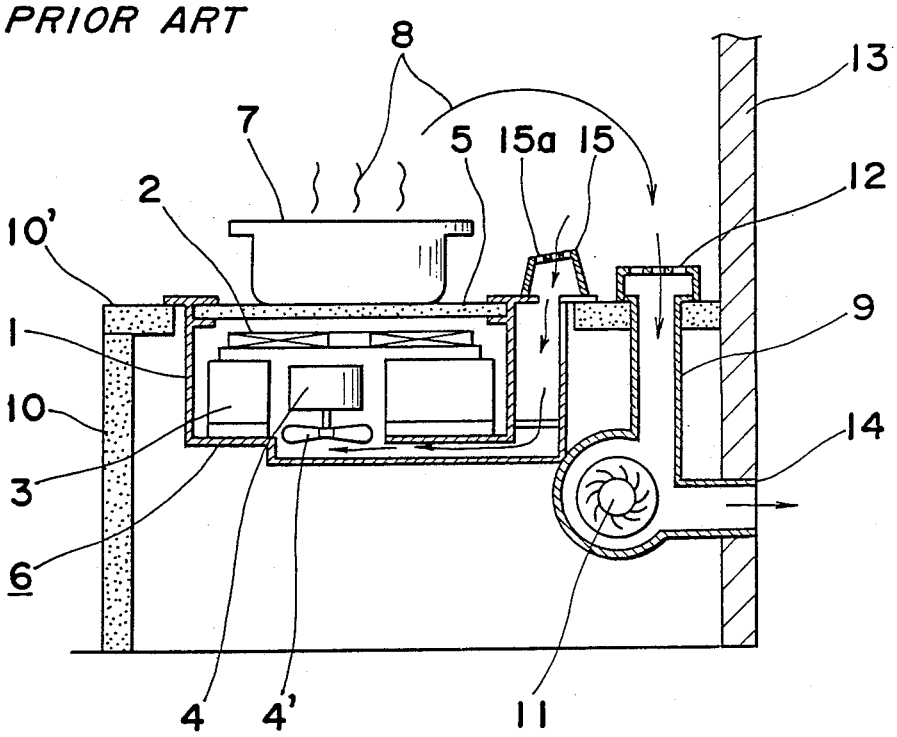
Fig. 7 PRIOR ART
FIG. 7 is a cross-sectional view taken along the line C—C' of FIG. 6.
Figure 8:
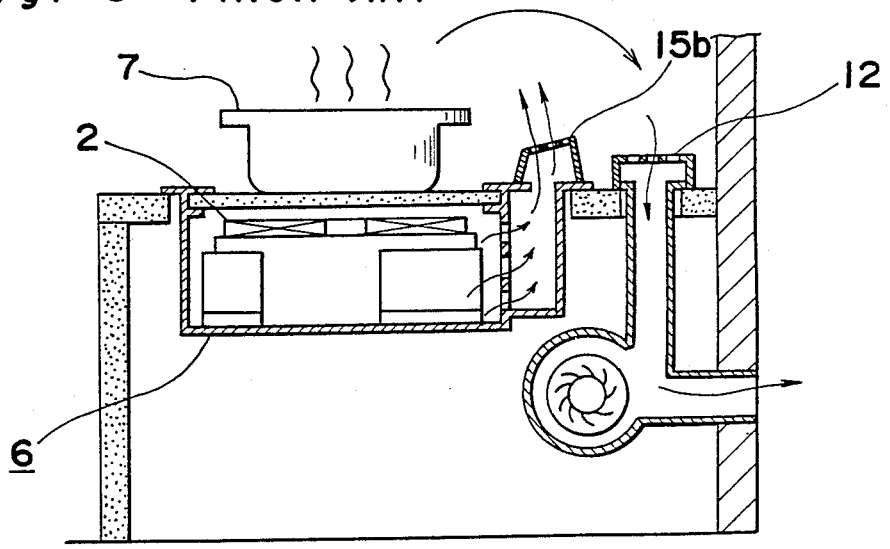
Fig. 8 PRIOR ART
FIG. 8 is a cross-sectional view taken along the line D—D' of FIG. 6.

In FIG. 5 showing the electromagnetic cooking apparatus of the third embodiment of the present invention, a compartment 43 of a main casing 42 of the apparatus and an exhaust unit 44*a* of a down exhaust device 44 are integrally formed. Ventilation holes 46 are provided at a front surface 45 of the cabinet. When a fan member 44' of the down exhaust device 44 operates, grease laden smoke, etc. 48 is sucked through a grill 47 above the main casing 42, and cooling air 49 for cooling inner components of the main casing 42 is drawn through ventilation holes 46' provided at the front surface 45 of the cabinet, so that the cooling efficiency is improved so much that a cooling device is not required for the main casing 42. As a result, the cooking apparatus itself can be compact and thin, and generates less noise because of the fanless main body 42.

As is clear from the foregoing description of the preferred embodiments of the present invention, the ventilation holes of the main body of the electromagnetic cooking apparatus are arranged to be open to the exhaust passage of the exhaust device. Therefore, the suction force of the fan member of the exhaust device is able to be used for exhausting the cooling air, thereby contributing to an improvement in the cooling efficiency of the cooking apparatus. Moreover, since the cooling device can be compact and thin according to the present invention, consequently, the cooking apparatus itself can be miniaturized.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A suction and exhaust system of a heat cooking apparatus comprising:

a main casing defining a compartment adapted to house heating components of the cooking apparatus, and a ventilation hole open to said compartment;

a cooling device disposed in an air cooling relationship with said compartment for introducing cooling air into said compartment;

an exhaust device defining an exhaust intake open to the exterior of the system and an exhaust passage extending from said exhaust intake, and said exhaust device comprising a fan disposed in an air suction relationship with said exhaust passage for generating suction to draw vapors generated by an object to be heated by the apparatus through said exhaust intake and into said exhaust passage, said exhaust passage open to said ventilation hole, and said exhaust device disposed in an air suction relationship with said compartment through said ventilation hole in which the suction generated by said fan also draws the cooling air introduced into said compartment by said cooling device through said ventilation hole and into said exhaust passage; and a switch operatively connected to said fan for turning said fan on and off independently of the operation of said cooling device.

2. A suction and exhaust system as claimed in claim 1, and further comprising a filter disposed in said exhaust passage at a location downstream of said ventilation hole with respect to the direction in which cooling air is drawn into said exhaust passage by said suction generating means.

* * * * *